United States Patent [19]

Hasegawa et al.

[11] Patent Number: 4,628,813

[45] Date of Patent: Dec. 16, 1986

[54] STENCIL DUPLICATOR PROVIDING AUTOMATIC STENCIL PERFORMATION, CHARGING, PRINTING, AND DISPOSAL

[75] Inventors: Takanori Hasegawa, Tokyo; Shuntaro Yoshida; Susumu Oshio, all of Tokyo, Japan

[73] Assignee: Riso Kagaku Corporation, Japan

[21] Appl. No.: 789,367

[22] Filed: Oct. 22, 1985

[63] Continuation of Ser. No. 544,723, Oct. 24, 1983, abandoned.

[30] Foreign Application Priority Data

Nov. 26, 1982 [JP] Japan ..... 57-207216

[51] Int. Cl.[4] ..... B41L 13/06

[52] U.S. Cl. ..... 101/116; 101/128.4; 101/227; 355/102

[58] Field of Search ..... 101/128.4, 116, 227, 101/117; 355/102

[56] References Cited

U.S. PATENT DOCUMENTS

| | | | |
|---|---|---|---|
| 612,550 | 10/1898 | Schwarz | 355/102 |
| 700,807 | 5/1902 | Palmer | 101/227 |
| 887,063 | 5/1908 | Carter | 101/116 |
| 934,077 | 9/1909 | Kunath | 101/117 |
| 3,788,221 | 1/1974 | Borneman | 101/116 |
| 3,904,877 | 9/1975 | Hasegawa et al. | 101/128.4 |
| 4,091,727 | 5/1978 | Hasegawa et al. | 101/128.4 |
| 4,323,775 | 4/1982 | Hasegawa et al. | 250/317.1 |

*Primary Examiner*—Clyde I. Coughenour

*Attorney, Agent, or Firm*—Stevens, Davis, Miller & Mosher

[57] ABSTRACT

The stencil duplicator includes: a cylindrical porous rotary printing drum and a means for selectively rotating it in a preferred direction; a means for clamping the leading edge of a stencil master along a generator of the printing drum; a means for supplying printing ink to the inner surface of the printing drum; a press roller means for pressing a paper sheet to the outer surface of the printing drum with a progressive rolling action; a means for feeding a paper sheet between the printing drum and the press roller means; a means for making a stencil master, including a light transmitting plate, a light source which selectively illuminates the light transmitting plate, and a pressure plate facing the light transmitting plate, with the light transmitting plate and the pressure plate being selectively able either to be separated or pressed together; a means for feeding the leading edge of a stencil master which has passed between the light transmitting plate and the pressure plate towards the clamping means so that it may be clamped thereby; and a means for controlling operation so that, when the light transmitting plate and the pressure plate are separated from one another with a stencil master interposed therebetween, the printing drum is rotated and by pulling via the clamping means on the leading edge of the stencil master withdraws it and wraps it around the printing drum.

2 Claims, 3 Drawing Figures

STENCIL DUPLICATOR PROVIDING AUTOMATIC STENCIL PERFORMATION, CHARGING, PRINTING, AND DISPOSAL

This application is a continuation of application Ser. No. 544,723, filed Oct. 24, 1983 now abandoned.

BACKGROUND OF THE INVENTION

The present patent application has been at least partially prepared from material included in Japanese Patent Application No. Sho 57-207216 (1982) which was invented by the same inventors as the present patent application and is assigned to the same assignee, and the present patent application hereby incorporates the text of that Japanese Patent Application and the claim or claims and the drawing thereof into this specification by reference; a copy is appended to this specification.

The present invention relates to a stencil duplicator, and more particularly relates to a stencil duplicator in which a means for making a stencil master sheet by thermal perforation is combined with a single drum type rotary stencil printing device, to provide a stencil duplicator which can operate entirely automatically without manual intervention.

Various forms of stencil duplicator are already known in which a stencil master is made and then stencil printing is performed by using said stencil master. Further, the thermal perforation process for making such a stencil master is already per se well known and applied to such duplicators. One such prior art stencil duplicator will now be described.

In this prior art, a stencil master making means is provided which comprises: a cylinder of transparent glass which can be rotated around its central axis; a light source provided inside this transparent glass cylinder; and a pressure belt a portion of which is pressed against a portion of the outside of the transparent glass cylinder, said pressure belt being moved at the same speed as the speed of the outside of the transparent glass cylinder as it rotates and in the same direction, in synchronism therewith. Thus, a sandwich of, radially on the inside, a piece of thermally sensitive stencil master material, and, radially on the outside, an original to be printed from with its relevant patterned face radially towards the inside, is transported in a rolling fashion around the outside of the transparent glass cylinder while being pressed thereagainst by the pressing action of the pressure belt, while the light source is continuously emitting light, and thereby the stencil master sheet is perforated photothermally in a per se well known fashion. As this is being done, or afterwards, one end of the stencil master thus perforated is attached to the outer surface of a cylindrical printing drum (which is different and separate from the transparent glass cylinder) and by rotating the cylindrical printing drum the perforated stencil master is wrapped therearound. Subsequently printing is carried out using the stencil master as thus wrapped around the printing drum.

Such a stencil duplicator is very convenient and effective for use, because stencil master making, attachment of a new stencil master to the printing drum, and printing therefrom, can all be quickly and continuously carried out, but unfortunately such a prior art form of stencil duplicator has suffered from several serious problems, which have deteriorated its effectiveness during use.

In detail, in order to provide high quality thermal perforation is is desirable that the stencil master sheet material and the original should be pressed together with a very considerable pressing force, in order to obtain very good heat transfer between them during illumination by the light source for thermal perforation and in order to obtain high resolution stencil master perforation; but using the above described apparatus incorporating a transparent glass cylinder and a pressure belt it is very difficult to provide a high degree of pressure. Even if a high level of pressure were able to be obtained with this sort of arrangement, this high pressure between the pressure belt and the surface of the transparent glass drum would mean that the frictional resistance between the sandwich of the original and the thermal master sheet material and the glass cylinder and/or the pressure belt would be likewise increased, and this would be likely to cause the production of wrinkles in the stencil master sheet material, which would be longitudinally accentuated and become worse as the rolling of the belt on the outside of the glass cylinder was continued.

To discuss this wrinkling problem in more detail, while the sandwich of the original and the thermal master sheet material is thus being transported, the thermal master sheet is liable to undergo wrinkling; and once even a small such wrinkle has appeared in the stencil master sheet, as it continues to be transported during the stencil perforation process this wrinkle will gradually grow larger and become extended in the longitudinal direction (the direction of transport), until it is so large as to prevent proper stencil perforation. Further, such stencil master wrinkling can also be caused by contact with the original, because of variations in the moisture content or the paper quality of the original, and because of small variations in the way in which the original is inserted into the machine to begin with. This stencil master wrinkling can seriously deteriorate the quality of copying attained with the stencil master perforation process, and result in poor copies. In the worst case, even jamming of the machine can occur.

Further, such wrinkles introduced into the stencil master during the process of thermal perforation thereof often are not eliminated as the stencil master is wrapped around the printing drum for subsequent printing, but remain and even are amplified, so that sometimes the stencil master cannot even be properly wrapped around the printing drum. In particular, in the case of an automatic stencil duplicator in which the material for a succession of stencil masters is automatically repeatedly and continuously cut from a roll of stencil master sheet material, these stencil masters, the material of which is very thin and flimsy, are not provided with any form of header or backing sheet such as one made of cardboard or the like for handling and fixing, but are just raw slabs of thermal master material which must be handled and fixed as they are. In such a case, when this stencil master sheet is pressed against the outer surface of the transparent glass drum in the stencil duplicator outlined above, together with the original, wrinkling will virtually always occur, and these wrinkles will not disappear so long as the thermal master material is pressed against the surface of the transparent glass drum but will remain. Further, as the stencil masteer is transported by the above described rolling action while pressed against the glass drum, these wrinkles will be amplified in the direction of rolling and will grow larger.

A contributory factor to this problem is that, with a stencil duplicator of the above described type, in order to wrap the perforated stencil master properly around the outer peripheral surface of the printing drum without any lateral wrinkles developing in such wrapping, a certain tension is required to be applied to the stencil master as it is fed out from the stencil master perforation section to be wrapped around the printing drum with the printing drum rotating. However, if such tension is applied in order to prevent lateral wrinkling of the stencil master, there is no chance of the longitudinal wrinkles that may have formed in the stencil master being eliminated, and on the contrary these longitudinal wrinkles may become even more accentuated.

SUMMARY OF THE INVENTION

Accordingly, it is the primary object of the present invention to provide an entirely automatic stencil duplicator which does not require any manual intervention for making stencil masters and for printing copies therefrom.

It is a further object of the present invention to provide such a stencil duplicator, which can provide a high degree of pressure between an original and a piece of thermal stencil master material which is to be perforated according to the pattern on said original, in order to provide a high quality of stencil perforation with high resolution.

It is a further object of the present invention to provide such a stencil duplicator, which does not suffer from the problem of wrinkling in the stencil master material during the manufacture of a perforated stencil master.

It is a further object of the present invention to provide such a stencil duplicator, which does not suffer from the problem of wrinkling in the stencil master material during the process of wrapping the perforated stencil master onto a printing drum for subsequent printing therefrom.

It is a further object of the present invention to provide such a stencil duplicator, which is well adapted to the use of continuous roll thermal master sheet material, in which the individual stencil master sheets made following the patterns on originals are not provided with any reinforced header portions for handling and fixing, but are properly handled even though they are thin and flimsy.

It is a further object of the present invention to provide such a stencil duplicator, which does not suffer from either longitudinal wrinkling or lateral wrinkling of the stencil master.

It is a yet further object of the present invention to provide such a stencil duplicator, in the operation of which it does not occur that wrinkles in the stencil master material caused during the stencil perforation process are accentuated during the process of wrapping the perforated stencil master onto a printing drum for subsequent printing therefrom due to tension provided in said perforated stencil material for the purpose of avoiding the generation of transverse wrinkles therein.

According to the most general aspect of the present invention, these and other objects are accomplished by a stencil duplicator, comprising: (a) a rotary printing drum formed as a hollow cylinder with multiple holes from its inside to its outside and rotatably mounted; (b) a means for selectively rotating said printing drum in at least a preferred direction of rotation; (c) a means for clamping the leading edge in said preferred rotational direction of said printing drum of a stencil master sheet substantially along a generator of said printing drum; (d) a means for supplying printing ink to the inner cylindrical surface of said printing drum; (e) a press roller means for pressing a sheet on which printing is required to be performed to the outer surface of said printing drum with a progressive rolling action; (f) a means for feeding a sheet of paper between said printing drum and said press roller means; (g) a means for making a stencil master sheet, comprising: (g1) a light transmitting plate; (g2) a light source which selectively illuminates said light transmitting plate; and (g3) a pressure plate facing said light transmitting plate; (g4) at least one of said light transmitting plate and said pressure plate being selectively movable towards and away from the other, so that said light transmitting plate and said pressure plate may either be selectively separated from one another or pressed together; (h) a means for feeding the leading edge of a stencil master sheet which has passed between said light transmitting plate and said pressure plate of said stencil master sheet making means towards said clamping means so that it may be clamped thereby; and (i) a means for controlling the operation of said components so that, when said light transmitting plate and said pressure plate of said stencil master sheet making means are in the state of being separated from one another with a stencil master sheet at least partly interposed therebetween, said printing drum is rotated in said preferred direction of rotation thereof and by pulling via said clamping means on the leading edge of said stencil master sheet withdraws said stencil master sheet from said stencil master sheet making means and wraps said stencil master sheet around said printing drum.

According to such an apparatus, a new stencil master is perforated in a pattern corresponding to the pattern on an original as follows, under the control of the control means. First, a sandwich composed of a piece of stencil master material and an original is inserted between the light transmitting plate and the pressure plate of the means for making a stencil master sheet, with the stencil master material on the side of the light transmitting plate and with the pattern on the original pressed against said stencil master material, and with the leading edge of the stencil master material brought out from the means for making a stencil master sheet and fed towards the clamping means and clamped thereby to the outside surface of the printing drum along its said generator. Thus, the light transmitting plate is constructed in an oblong shape having substantially the same transverse dimension as the original; but typically the light transmitting plate will be much shorter in the longitudinal direction than the original. Next, the light transmitting plate and the pressure plate of the means for making a stencil master sheet are pressed together, and the light source is operated so as to perforate the portion of the stencil master sheet which is exposed thereto through the light transmitting plate. During this stencil perforation process, a very high pressure per square unit of the stencil master and the original can be provided, because typically only a relatively small strip of the original is being exposed at one time. Thus, because the stencil master sheet and the original are stationary and pressed together at this time, there is no danger of wrinkling of the stencil master sheet. Next, the light transmitting plate and the pressure plate are separated to a certain extent, so as to relieve the pressure between the original and the stencil master sheet (which will release any small wrinkles which may possibly have been generated and allow them to smooth out, so they do not become amplified), and the printing drum is then rotated through just the right angle to gently pull the stencil master, via the clamping means, and the original which is adhered thereto by virtue of the thermal perforation process, just that distance along between the light transmitting plate and the pressure plate of the means for making the stencil master sheet which will place a new strip of the original and of the stencil master sheet against and opposing the light transmitting plate for the next perforating exposure. This gentle pulling further serves to smooth out wrinkles in the stencil master sheet, and does not risk increasing any slight longitudinal wrinkles that might have occurred in the stencil master sheet, but rather smooths them out. Then the light transmitting plate and the pressure plate are pressed together again, and another exposure is made, so as to perforate another strip of the stencil master sheet; advantageously, a slight overlap may be allowed between this strip and the previous one, and this will not deteriorate the quality of the perforation process. This process of strip exposure and then winding of the stencil sheet around the printing drum is repeated a number of times, until the entire stencil master sheet corresponding to the desired pattern on the original has been perforated and wrapped around the printing drum.

Subsequently the stencil printing process is performed, again under the control of the control means, by the printing drum being turned while the ink supplying means supplies ink to the interior thereof and the press roller means repeatedly presses sheets of paper onto the outer surface of said printing drum with a progressive rolling action, said sheets of paper being fed by said feeding means between said printing drum and said press roller means. It will be thus understood that the present invention provides an entirely automatic stencil duplicator which does not require any manual intervention for making stencil masters and for printing copies therefrom, and which can provide a high degree of pressure between an original and a piece of thermal stencil master material which is to be perforated according to the pattern on said original, in order to provide a high quality of stencil perforation with high resolution. Further, the problems of wrinkling in the stencil master material during the manufacture of a perforated stencil master, as well as during the process of wrapping the perforated stencil master onto the printing drum for subsequent printing therefrom, are avoided. Thus, this duplicator is well adapted to the use of continuous roll thermal master sheet material, in which the individual stencil master sheets made following the patterns on originals are not provided with any reinforced header portions for handling and fixing, and ensures their proper handling even though they are thin and flimsy, without any risk of either longitudinal wrinkling or lateral wrinkling of them. Further, during operation of this stencil duplicator, wrinkles in the stencil master material caused during the stencil perforation process are not caused to be accentuated during the process of wrapping the perforated stencil master onto the printing drum for subsequent printing therefrom due to tension provided in said perforated stencil material for the purpose of avoiding the generation of transverse wrinkles therein, but rather are smoothed out.

Further, according to a more particular aspect of the present invention, these and other objects are more particularly and concretely accomplished by a stencil duplicator as described above, further comprising a means for cutting transversely across said stencil master sheet and for separating a portion thereof to be wrapped around said printing drum.

According to such an apparatus, the stencil master sheet used may initially be in a bulk form such as roll form, and after the perforation process it may be cut by said cutting means, the cut piece being wrapped around the printing drum.

Further, according to another more particular aspect of the present invention, these and other objects are more particularly and concretely accomplished by such a stencil duplicator as first specified above, further comprising a means for separating an original from a stencil master sheet to which said original has become adhered, as said original and said stencil master sheet are removed from said stencil master sheet making means.

According to such an apparatus, even if the original and the stencil master perforated in accordance with the pattern thereon are stuck together quite tightly, which typically may occur with the thermal stencil perforation process, they will be efficiently separated by said means for doing so.

Further, according to a yet more particular aspect of the present invention, these and other objects are more particularly and concretely accomplished by such a stencil duplicator as first specified above, further comprising a means for removing a used stencil sheet from around the outer cylindrical surface of said printing drum and for disposing of said used stencil sheet.

According to such an apparatus, since the used stencil can be disposed of automatically, the machine may be automatically readied for the next stencil making phase of operation; and this facilitates fully automatic operation of the stencil duplicator.

BRIEF DESCRIPTION OF THE DRAWINGS

The present invention will now be shown and described with reference to the preferred embodiment thereof, and with reference to the illustrative drawings. It should be clearly understood, however, that the description of the embodiment, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and features are denoted by like reference symbols in the various figures thereof, and:

DESCRIPTION OF THE PREFERRED EMBODIMENT

Figure 1:
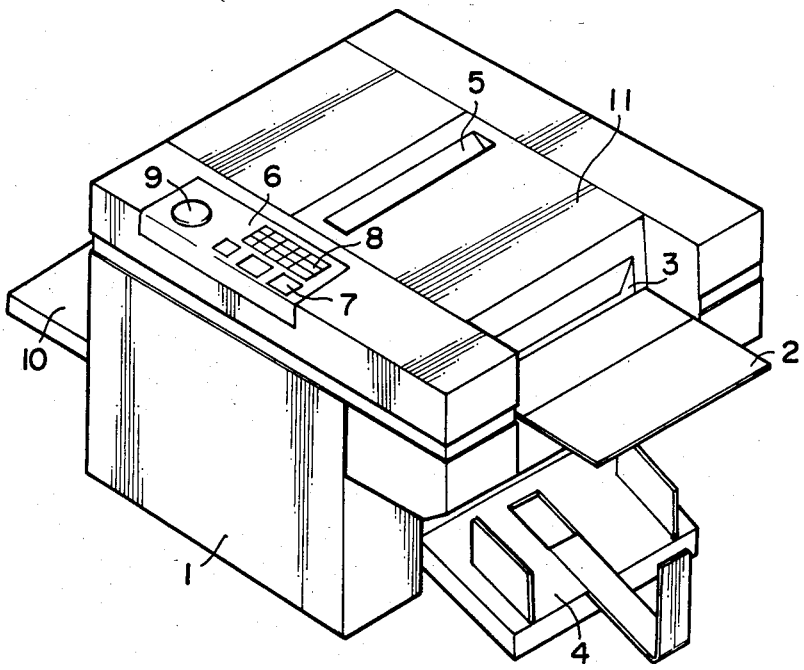
FIG. 1 is a perspective view of the exterior of the preferred embodiment of the stencil duplicator of the present invention.

The present invention will now be described with reference to the preferred embodiment thereof, and with reference to the appended drawings. FIG. 1 shows the preferred embodiment of the stencil duplicator of the present invention in overall exterior perspective view. In this figure, the reference numeral 1 denotes a cabinet assembly of the stencil duplicator, which contains within it both a stencil making means for making a stencil master from an original and also a stencil printing means for printing multiple copies from said stencil master. At the front side of the cabinet assembly 1 in the drawing there is provided an original insertion table 2 for placing an original on ready to be inserted into the duplicator in order to make a stencil master therefrom. Below the insertion table 2 there is provided an output stacker 4 for receiving a stack of multiple printed copies made by the duplicator, and on the rear side of the cabinet assembly 1 there is provided a paper loading tray 10 for providing to the stencil duplicator a supply of blank paper which is to be used for printing on. An upper cover 11 which is removable closes the upper side of the cabinet assembly 1. In this upper cover 11 there is formed an original insertion slot 3, located just above that edge of the original insertion table 2 which is joined to the cabinet assembly 1, for passing said original laid on the table 2 into the interior of the stencil duplicator; and further there is formed an original ejection slot 5 through which, once it has been finished with, said original is ejected from the inside of the stencil duplicator. At a side upper portion thereof the cabinet assembly 1 is provided with an operating panel 6. This operating panel 6 has various controls such as dials and buttons and switches activated by touch panels or the like incorporated therein, including for example a start button 7, a print quantity setting keyboard 8, and a print density adjustment dial 9, and is used by the operator of the stencil duplicator for controlling various functions thereof, such as for example how many copies should be printed from an original and of what intensity these copies should be, as well as for starting stencil printing. The output electrical signals from the operating panel 6 are dispatched to a control system for the stencil duplicator which will be described with regard to its function hereinafter. However, as will be explained later, the constructional details of this control system for the stencil duplicator, and of the control panel 6, do not form part of the present invention, and will not be further particularly described herein, since based upon the disclosures herein various possible structures for this control system, etc., will be readily conceived of by one of ordinary skill in the control art.

Figure 2:
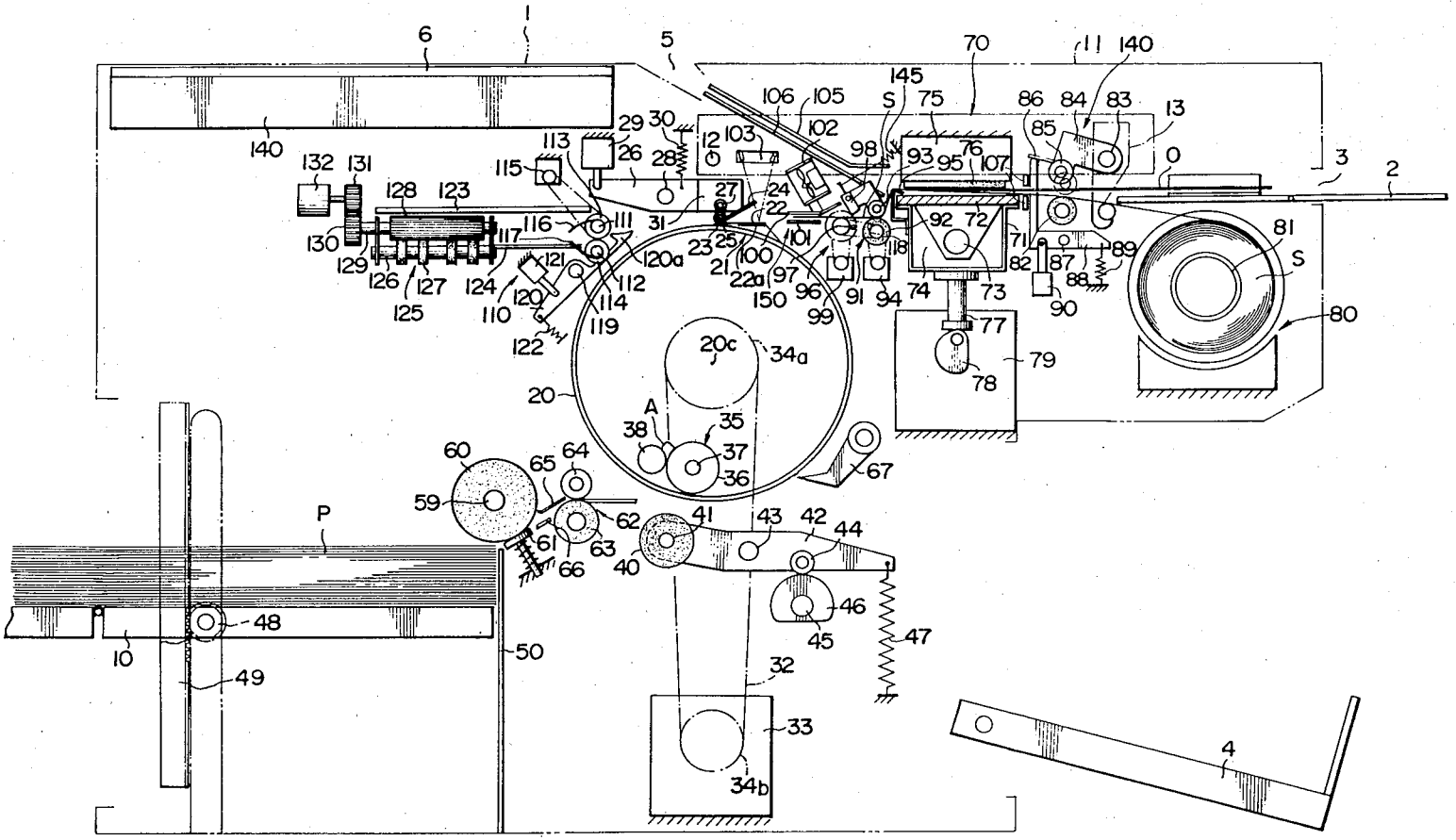
FIG. 2 is a schematic structural part sectional side view showing the internal mechanisms of the stencil duplicator shown in FIG. 1 in a certain operational state.
Figure 3:
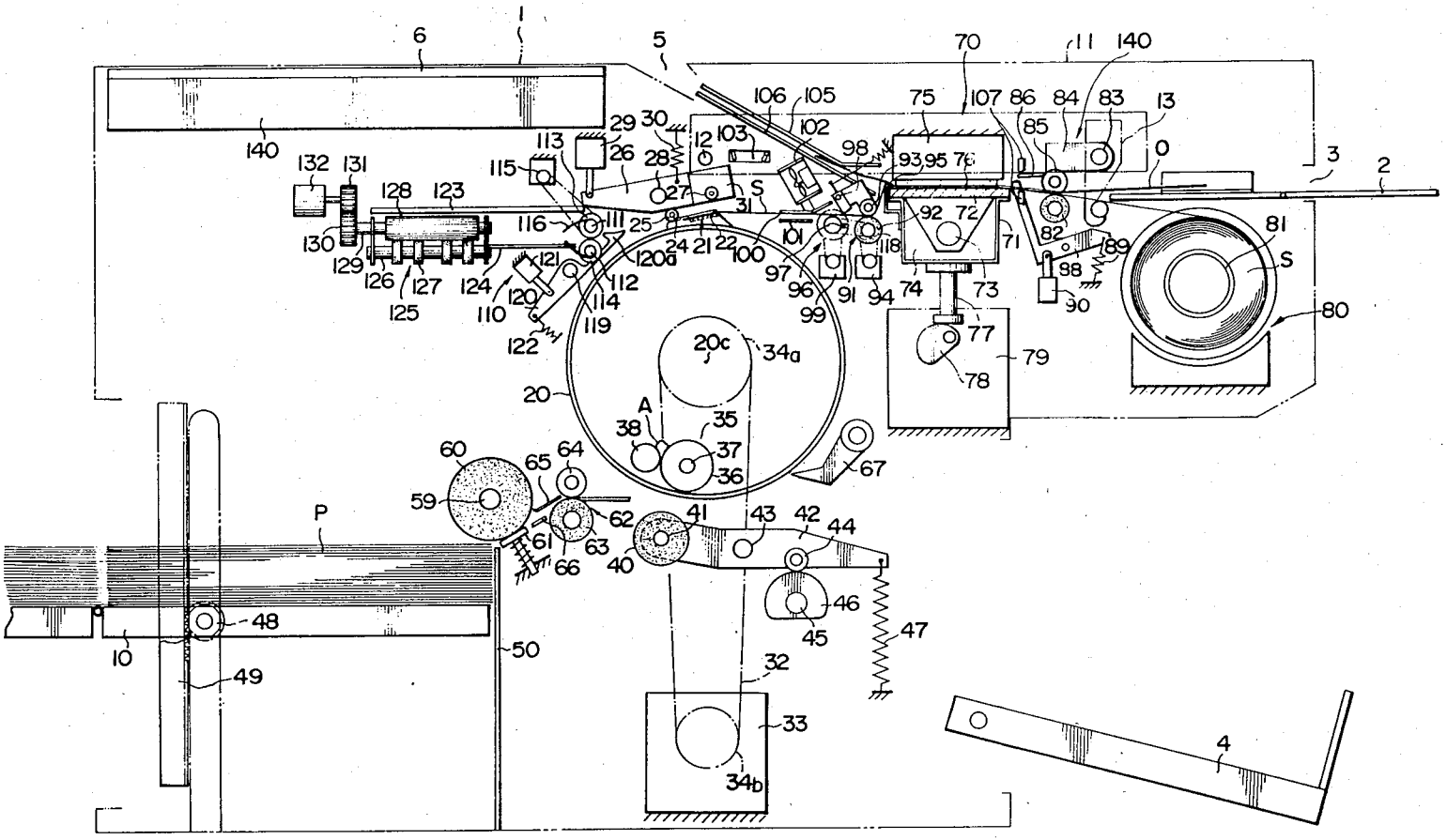
FIG. 3 is a schematic structural part sectional side view, similar to FIG. 2, showing the same mechanisms in a different stage of their operation.

FIGS. 2 and 3 show the internal mechanisms within the stencil duplicator of FIG. 1 in detail in part sectional schematic side view, in two different operational conditions as will be explained in detail later.

In these figures, the reference numeral 20 denotes a printing drum, which is formed as a hollow cylinder and is rotatably supported on a main frame not shown in the figures by arrangements which are also not shown in a generally horizontal orientation, and is thus rotatable about its central axis 20*c*; this supporting need not be axial, but may be on a combination of rollers which roll on the outside end edges of the printing drum 20, for example. This printing drum 20 is formed with multiple small perforations through its cylindrical surface from the space inside it to the outside. A clamp means generally designated as 21 is provided on the outside cylindrical surface of the printing drum 20, extending generally along a generator thereof and thus only visible in transverse section in the figures, for clamping the leading edge of a piece of stencil master material to the printing drum 20 along said generator.

In more detail, this clamp means 21 comprises a permanent magnet strip 22 which is fixed to the outer surface of said printing drum 20 extending along a generator thereof, in fact constituting the flat upper surface of a stage 22*a*. The long edge of a clamp strip 24 made of magnetically attractable material is hinged by a hinge shaft 23 along the long edge parallel to the generators in the anticlockwise direction of the printing drum 20 in the figure of the stage 22*a*. Thus, the clamp strip 24 can be pivoted to and fro relative to the printing drum 20 around the hinge shaft 23, either in the clockwise direction in the figures so as to be applied against the permanent magnet strip 22 and so as to be magnetically held thereto, or in the anticlockwise direction in the figures so as to be removed from the permanent magnet strip 22. At one end of the hinge shaft 23 there is fixedly mounted a gear wheel 25, and this gear wheel 25 is selectively meshed, when the printing drum 20 is in the rotational position shown in FIG. 2 which hereinafter will be called the base rotational position, with another gear wheel 27 which is rotatably supported on one end of a lever 26. The lever 26 is pivoted at a central portion thereof to the aforesaid main frame (not shown) of the mechanism by a pivot 28, is biased in the anticlockwise direction in the figures by a tension spring 30, and is selectively driven in the clockwise direction in the figures by a solenoid 29 which is attached to the other end of said lever 26.

Thus, when the solenoid 29 is not supplied with actuating electrical energy, then the lever 26 is rotated by the biasing action of the tension spring 30 in the anticlockwise direction so as irrespective of the rotational position of the printing drum 20 positively to ensure disengagement of the gear wheel 27 from the gear wheel 25; but, on the other hand, when the solenoid 29 is supplied with actuating electrical energy, then the lever 26 is rotated by the action of said solenoid 29 in the clockwise direction in the figure against the biasing action of the tension spring 30 which is overcome so as to approach the gear wheel 27 towards the central axis of the printing drum 20, and so as, if the printing drum 20 is in its shown base rotational position, to drivingly engage the gear wheel 27 with the gear wheel 25. In this position, if the gear wheel 27 is appropriately rotated by an electric motor 31, which is provided for the purpose of driving it, in the clockwise or the anticlockwise rotational direction respectively, then the gear wheel 25 and the hinge shaft 23 and the clamp strip 24 are thereby rotated in the anticlockwise or the clockwise rotational direction respectively, and can be positioned to any appropriate one of three rotational positions: a first so called clamping position in which the clamp strip 24 is applied to and is magnetically held by the permanent magnet strip 22; a second intermediate so called clamp ready position as shown in FIG. 2 in which the clamp strip 24 is removed from the permanent magnet strip 22 but only makes an acute angle therewith; and a third so called fully unclamped position in which the clamp strip 24 is pivoted approximately 180° away from the permanent magnet strip 22. The solenoid 29 and the electric motor 31 are selectively and appropriately supplied with actuating electrical energy by the control system for the stencil duplicator, to be functionally described presently.

This clamp means 21 has been developed by various colleagues of the present inventors, along with some of the present inventors, in the workshops of the company to which the present patent application is assigned; should more details regarding said clamp means 21 be required, reference should be made to Japanese Patent Application No. Sho 57-207217, which is assigned to the same assignee as the present application; and the present patent application hereby incorporates the text of that Japanese Patent Application and the claim or claims and the drawing thereof into this specification by reference.

The printing drum 20 is drivingly coupled to a sprocket wheel 34*a* which is coaxially coupled thereto, and this sprocket wheel 34*a* is drivingly coupled by an endless chain 32 to another sprocket wheel 34*b* which is selectively rotated by an electric motor 33. The printing drum 20 is thus selectively rotated, in the anticlockwise direction as seen in the figure only, by the electric motor 33, according to the operation of the aforementioned control system which selectively powers the electric motor 33, either continuously or in step motion as appropriate as will be explained later.

In the inside space within the printing drum 20 there is provided a printing ink supply means, generally designated as 35, for steadily providing a supply of printing ink to the inside surface of the printing drum 20. This ink supply means comprises an ink supply roller 36 which is mounted so as to be rotatable about its central axis 37, and a doctor roller 38 which is also mounted so as to be rotatable about its central axis parallel to said central axis 37 of the ink supply roller 36, with a certain small gap being present between said doctor roller 38 and said ink supply roller 36. During operation of the duplicator, an elongated pool A of viscous ink is maintained as resting in the niche formed by the upper surfaces of the doctor roller 38 and the ink supply roller 37, and the ink supply roller 36 is rotated in the counterclockwise direction in the figures at a speed which causes its surface to move at the same speed as that of the inside surface of the printing drum 20 which it touches, while the doctor roller 38 is rotated in the clockwise direction as seen in the figures at an appropriate rotational speed; and this rotation of the ink supply roller 36 and the doctor roller 38 constantly churns up the ink in the pool A and steadily entrains a supply thereof in a layer of substantially uniform thickness down through said gap between said doctor roller 38 and said ink supply roller 36, around said ink supply roller 36, and onto the inside surface of said printing drum. This ink is then used for printing copies as will be explained hereinafter.

This ink supply means 20 has been developed by various colleagues of the present inventors, along with some of the present inventors, in the workshops of the company to which the present patent application is assigned; should more details regarding said ink supply means 20 be required, reference should be made to Japanese Patent Applications Nos. Sho 53-128043 (1978), Sho 55-126934 (1980), and Sho 57-122589 (1982), all of which are assigned to the same assignee as the present application; and the present patent application hereby incorporates the text of those Japanese Patent Applications and the claim or claims and the drawings thereof into this specification by reference.

Below the printing drum 20 and parallel thereto there is provided a press roller 40, which is rotatably supported on one end of a lever 42 by a pivot 41. The lever 42 is pivoted at a central portion thereof to the aforesaid main frame (not shown) of the mechanism by a pivot 43, is biased in the clockwise direction in the figures by a tension spring 47, and is selectively driven in the anticlockwise direction in the figures by a cam 46 mounted on a cam shaft 45 which presses against a cam follower roller 44 mounted on said lever 42.

Thus, when the cam 46 presses the cam follower roller 44 upwards in the figure against the biasing action of the tension spring 47 which is overcome, by being rotated to a position such as that shown in the figure, then the lever 42 is rotated by the biasing action of the tension spring 47 in the clockwise direction so as to remove the press roller 40 from the surface of the printing drum 20; but, on the other hand, when the cam 46 allows the cam follower roller 44 to move downwards in the figure, by being rotated to a position about 180° from that shown in the figure, then by the biasing action of the tension spring 47 the lever 42 is rotated in the clockwise direction in the figure so as to approach the press roller 40 towards the surface of the printing drum 20 to press against it. As will be understood later, during the stencil master ejection and attachment operations, the cam 46 is rotated to the position shown in the figures so as to remove the press roller 40 from the surface of the printing drum 20; while, during the operation of printing multiple copies from a stencil master, the cam 46 is rotated in synchronism with the rotation of the printing drum 20, so as to press the press roller 40 against the surface of the printing drum 20 during substantially all phases of the revolution of the printing drum 20 except during the passing of the clamp means 21 past said press roller 40, at which time said press roller 40 is removed from the surface of the printing drum 20 so as to let the clamp means 21 move past.

The paper loading tray 10 is substantially horizontal and is slidably mounted on and movable in the vertical direction with respect to the frame (not shown but schematically suggested by the double dotted lines) of the stencil duplicator. On the paper loading tray 10 there is provided an electric motor not shown in the figure, which is selectively powered from the aforementioned control system, and which drives a pinion 48 which is meshed with a vertically extending fixed rack 49. Thus, according to the rotation of the aforesaid electric motor in the one or the other direction, the paper table 10 can be raised or lowered with respect to the frame of the stencil duplicator. A vertically extending stop plate 50 is provided at the right hand side of the paper table 10, and as shown in the figure during the operation of the stencil duplicator a stack P of printing stock paper is laid on the paper loading tray 10 with the right sides of the sheets thereof abutted against the stop plate 50 so as to line up said sheets. The operation of the aforesaid motor which drives the pinion 48 is controlled by the control system in response to the amount of printing paper remaining on the paper loading tray 10, so as to appropriately position the paper loading tray 10 to always keep the right hand edge of the uppermost one of the stack P of sheets of printing paper against the lower edge of a paper feed roller 60 which is rotatably mounted via a shaft 59 to the frame of the stencil duplicator and is selectively driven in the anticlockwise direction in the figures by an electric motor not shown in the figures controlled by the aforesaid control system. This paper feed roller 60 is constructed of a material such as rubber or artificial rubber which has a high coefficient of friction, and when thus rotated pulls the top sheet of paper off the stack P on the paper loading tray 10 and, in combination with a press pad 61 which is biased against said paper feed roller 60, feeds said sheet of paper rightwards in the figure between guide plates 65 and 66 and through a register roller device 62 next to the press roller 40, comprising a drive roller 63 and a follower roller 64 which are rotated in synchronism with the rotation of the printing drum 20 and are started to rotate when the printing drum 20 is in a certain rotary position. Thus said sheet of paper is at an appropriate time, under control of the control system, fed in between the press roller 40 and the printing drum 20.

Near the surface of the printing drum 20, and on the other side of the press roller 40 from the register roller device 62, there is provided a peel off claw 67, which is pivotable by a means not shown in the figure which is controlled by said control device for the stencil duplicator, so that its free claw end is either approached close to the surface of the printing drum 20 (possibly into a groove formed thereon) or is withdrawn away from the surface of the printing drum 20. When the claw end of said claw 67 is thus approached towards said printing drum 20, it is appropriately positioned to scoop a sheet of paper off from the surface of the printing drum 20 as said printing drum 20 revolves in the anticlockwise direction in the figure and to direct said sheet of paper into the output stacker 4, into which said sheet of paper is thrown by its inertia as it is impelled tangentially off from the printing drum 20.

The operation of printing multiple copies from a stencil master, using the paper feed and removal means and the ink supply means described above, which has been adumbrated in the preceding structural description, will now be explained in detail. Before this operation is commenced, a stencil master perforated with a pattern of holes corresponding to the marks on an original is wrapped securely around the printing drum 20, with its leading edge gripped and held along a generator of said drum 20 by the clamp means 21, which holds it between the clamp strip 24 and the permanent magnet strip 22.

First, the control system activates the paper feed roller 60 and rotates it in the anticlockwise direction in the figure, so that it pulls the top sheet of paper off the stack P on the paper loading tray 10 and feeds its leading edge in between the rollers 63 and 64 of the register roller device 62. Next, the control system rotates the printing drum 20 anticlockwise in the figure, and at an appropriate time rotates the cam 45 (as has already been explained) so as to raise the press roller 40 away from the printing drum 20 so as to allow the clamp means 21 to pass said press roller 40, and just subsequently to this the control system again rotates the cam 45 so as to press the press roller 40 against the surface of the printing drum 20 with the part of the stencil master just after the leading edge thereof interposed therebetween, and at the same time starts to rotate the rollers 63 and 64 of the register roller device 62 (and also rotates the paper feed roller 60) so as to feed the leading edge of said next sheet of printing paper between the press roller 40 and the stencil master wrapped around the printing drum 20. Thus the rolling contact of the press roller 40 and the printing drum 20 sucks in the paper sheet and squeezes it against the stencil master progressively, as the drum 20 and the press roller 40 rotate. Meanwhile the above described ink supplying means 35 has been steadily supplying ink to the inside surface of the printing drum 20, and this ink has been percolating through the multiple small perforations in the printing drum 20 to cover the inside surface of the printing master, and under the squeezing effect of the press roller 40 this ink is squeezed through the perforations of the stencil master (whose pattern corresponds to that on an original which was used for cutting the stencil master as will be described later) and becomes applied to the inner surface of the sheet of printing paper progressively according to said original pattern as the paper passes through between the press roller 40 and the printing drum 20. The leading edge of the paper comes into contact with the point portion of the claw 67, which is approached to the printing drum 20 by the control system at this time, and is peeled and scooped away from the stencil master and directed outwards towards the output stacker 4. When the printing paper has completely passed through between the press roller 40 and the printing drum 20, thus, it is ejected and comes to rest in the output stacker 4.

This completes the printing process for one sheet of paper. This printing process is typically repeated many times to print many printed copies from one stencil master, according to the instructions given to the control system from the control panel 6. Now the arrangements for making an appropriately perforated stencil master, for wrapping it onto the printing drum 20, and for removing it therefrom after the printing process has been completed and disposing of it, will be explained in detail.

A stencil making means generally designated by the reference numeral 70, for perforating a stencil master in a pattern corresponding to the pattern on an original, is provided at the upper part of the stencil duplicator, on the opposite side from the paper tray 10. This stencil making means 70 includes an exposure stage 74 and a pressure plate 75 located directly above the exposure stage 74; the exposure stage 74 is mounted to the main frame of the device (not shown) so as to be slidable in the vertical direction, and the pressure plate 75 is fixed to the upper cover 11 of the stencil duplicator. The exposure stage 74 comprises a light box 71 which is open at the top, a rectangular light transmitting plate 72 made of glass which closes said open top of the box 71, and a light source 73 such as a xenon flash tube mounted within the light box 71 so as to direct rays in the upwards direction, when so controlled to do so by the control system for the stencil duplicator. The pressure plate 75 and the glass light transmitting plate 72 directly oppose one another and are both substantially parallel, and the face of the pressure plate 75 opposing said light transmitting plate 72 is provided with a cushion member 76 of resilient spongelike material. To a lower portion of the exposure stage 74 there is fixed the upper end of a cam follower member 77, and the lower end of this cam follower member 77 is formed as a cam pad which rests against the face of a rotatable cam 78. The cam 78 is selectively rotated by an electric motor 79 in the clockwise and/or the anticlockwise direction, as appropriate, said electric motor 79 being controlled by the overall control system for the stencil duplicator; and thereby the cam follower member 77 drives the exposure stage 71, so that said exposure stage 71 either is positioned to a lower position, as shown in FIG. 2, in which the glass light transmitting plate 72 is removed from the cushion member 76 on the pressure plate 75 with a certain gap being left therebetween, or is positioned to an upper position, as shown in FIG. 3, in which the glass light transmitting plate 72 is pressed upwards against the cushion member 76 on the pressure plate 75, possibly with the intervention of an original and a piece of stencil master as will be explained later.

This stencil making means 70 has been developed by various colleagues of the present inventors, along with some of the present inventors, in the workshops of the company to which the present patent application is assigned; should more details regarding said stencil making means 70 be required, reference should be made to Japanese Patent Applications Nos. Sho 54-97944 (1979) and Sho 55-50078 (1980), both of which are assigned to the same assignee as the present application; and the present patent application hereby incorporates the text of those Japanese Patent Applications and the claim or claims and the drawings thereof into this specification by reference.

Under the original insertion table 2 there is provided a stencil master sheet material storage section 80, in which a roll of stencil master material S is kept as wound upon a bobbin 81. The outer edge of the original insertion table 2 protrudes to the outside of the stencil duplicator through the original insertion slot 3 as shown in FIG. 1, and the inner edge of the original insertion table 2 is at substantially the same height and opposed to the outer edge of the gap formed between the exposure stage 71 and the pressure plate 75. Between said inner edge of the original insertion table 2 and the thus defined outer side of the stencil making means 70 is provided a stencil master and original moving means 140, for feeding stencil master from said roll of stencil master to the stencil master making means 70, which is constructed as follows. A lower roller 82 is freely rotatably mounted to the frame (not shown) of the stencil duplicator, and an upper roller 85 is rotatably mounted to the free end of a first L-shaped lever 84, the other end of which is pivoted via a pivot 83 to the upper cover 11. A lug 86 is provided extending from the free portion of said first L-shaped lever 84, which is biased in the anticlockwise direction by the force of gravity acting thereon, so as to approach the upper roller 85 towards the lower free roller 84. A second L-shaped lever 88 is pivoted to the frame of the stencil duplicator by a pivot 87, and is biased in the clockwise direction in the figures by a tension coil spring 89 while being selectively driven in the anticlockwise direction by a solenoid 90 controlled by the overall control system for the stencil duplicator; and the other end of this second L-shaped lever 88 selectively is abutted against said lug 86 on said first L-shaped lever 84. Thus, when said solenoid 90 is not supplied with actuating electrical energy, then as shown in FIG. 2 under the biasing action of the tension coil spring 89 the second L-shaped lever 88 is driven in the clockwise direction in the figures so that its free end pushes said lug 86 upwards and moves the first L-shaped lever in the clockwise direction in the figure so as to raise the upper roller 85 away from the lower roller 82 and leave a certain gap therebetween; but, when on the other hand said solenoid 90 is supplied with actuating electrical energy, then as shown in FIG. 3 against the biasing action of the tension coil spring 89 which is overcome it drives the second L-shaped lever 88 in the anticlockwise direction in the figures, so that the free end of said first lever 88 releases said lug 86 and allows said lug 86 to move downwards so that the first L-shaped lever moves in the anticlockwise direction in the figure so as to lower said upper roller 85 down to touch against said lower roller 82 and close said gap.

Just between the combination of the upper and lower rollers 82 and 86 and the outer side of the stencil making means 70 is provided a photosensor system 107 of a per se well known sort, which supplies a signal to the control system for the stencil duplicator to indicate whether an original is intercepting light which is being passed between components of said photosensor system 107 across the entrance to the gap between the exposure stage 71 and the pressure plate 75 of the stencil making means 70.

Extremely close to the inner edge of the gap formed between the exposure stage 71 and the pressure plate 75, between the printing drum 20 and the thus defined inner side of the stencil making means 70, is provided an original and master separation and feed device 91, for separating a perforated stencil master from an original to which, as will be seen later, said perforated stencil master is stuck, at this stage in the apparatus. This separation and feed device 91 comprises an upper roller 93 rotatably mounted to the upper cover 11 and a lower roller 92 parallel to and in contact with and rolling against said upper roller 93 and rotatably mounted on the frame (not shown) of the stencil duplicator. An electric motor 94 controlled by the overall control system for the stencil duplicator selectively rotationally drives the lower roller 92 in the anticlockwise direction as seen in the figure (thus driving the upper roller 93 in the clockwise direction at the same time). Further, at an intermediate point in the power transmission path between said electric motor 94 and the lower roller 92 there is provided a one way clutch (not shown) which, when the electric motor 94 is not being operated, allows the lower roller 92 to be rotated in the anticlockwise direction (thus driving the upper roller 93 in the clockwise direction at the same time) with a certain amount of resistance. The line where the lower and upper rollers 92 and 93 meet is substantially lower than the inner edge of the gap formed between the exposure stage 71 and the pressure plate 75 (i.e. the outlet slot of the stencil making means 70), and thus, when as seen in FIG. 3 a piece of stencil master material S is passed between the exposure stage 71 and the pressure plate 75 and is also passed between the lower and upper rollers 92 and 93, this piece of stencil master material is bent through nearly a right angle as it leaves the stencil making means 70. At this bent position of the stencil master, there is provided a stencil master and original separation claw 95, which as will be seen later functions to separate an original and a stencil master which has been perforated according to the patterns thereon. The inner edges of two guide plates 105 and 106 are located proximate to this separation claw 95, and the outer edges of these guide plates 105 and 106 define the original ejection slot 5 at the exterior of the stencil duplicator.

Between the stencil master and original separation and feed device 91 and the printing drum 20 there is provided a stencil master cutter means 96 for cutting off a piece of the stencil master S which has been perforated in a pattern corresponding to the original from which it has been separated at this stage in the apparatus. This cutter means 96 comprises a rotatable lower blade 97, mounted to the frame of the stencil duplicator, which is selectively rotated by an electric motor 99, and a cooperating upper blade 98. In more detail, the rotatable lower blade 97 in fact is formed as a cylinder with a blade projecting from the outer surface thereof and extending almost along one of its generators but in fact angled at a slight angle to the generators of said cylinder so as to make a slight spiral around the surface of said cylinder; said spiral not extending around the axis of the cylinder a very large angle, however. The upper blade 98 is substantially straight, and is pivoted at its base to the upper cover 11 and biased by a tension coil spring 145. Thus, when the lower rotatable blade 97 is positioned to a position in which the blade thereof is on the lower side of the axis thereof, a certain space is present between said lower rotatable blade 97 and the upper blade 98, so that a piece of stancil master S can conveniently be passed therebetween; but, when the lower rotatable blade 97 is rotated through one revolution from this position in the counterclockwise direction in the figure, the blade edge thereof presses against the edge of the upper blade 98 (the point of contact therebetween sliding rapidly in the direction perpendicular to the drawing paper in FIGS. 2 and 3), slightly displacing said upper blade 98 against the biasing action of the tension coil spring 145, and quickly and efficiently slices transversely across said stencil master. The lower rotatable blade 97 is rotatably coupled via a belt 118 to the lower roller 92 of the original and master separation and feed device 91, with the interposition of a one way clutch which is not shown, so that when the lower rotatable blade 97 rotates the lower roller 92 is forced to rotate, but not vice versa.

Between the stencil master cutter means 96 and the printing drum 20 there is provided a stencil master transport means 150 for approaching the leading edge of the stencil master to the clamp means 21 on the printing drum 20. This stencil master transport means 150 comprises: an upper guide plate 100; a lower guide plate 101 provided below and parallel to said upper guide plate 100 with a gap being left therebetween, the edges on the left in the figure of the upper and lower guide plates 100 and 101 lying close to the printing drum 20 and parallel to the generators thereof; and a blower fan 102, which when operated blows from a position diagonally above said edges of the upper and lower guide plates 100 and 101 near the printing drum 20 towards said printing drum 20. This blower fan 102 is controlled by the control system for the stencil duplicator.

This stencil master transport means 150 has been developed by various colleagues of the present inventors, along with some of the present inventors, in the workshops of the company to which the present patent application is assigned; should more details regarding said stencil master transport means 150 be required, reference should be made to Japanese Patent Application No. Sho 57-207218, which is assigned to the same assignee as the present application; and the present patent application hereby incorporates the text of that Japanese Patent Application and the claim or claims and the drawing thereof into this specification by reference.

On the upper cover 11 there is provided a light reflection type photosensor 103, which by reflected light is able to detect, when the printing drum 20 is in its above described base rotational position as shown in FIG. 2 with the clamp means 21 opened, whether or not the leading edge of a piece of stencil master is present over the permanent magnet strip 22 on the stage 22*a*. The upper cover 11 is pivotally supported by being fixed to the frame of the stencil duplicator (not shown) by a pivot 12, and can either be pivoted in the clockwise direction in the figure to a closed position as shown in FIGS. 1 and 2 in which it covers the upper opening of the body of the stencil duplicator and is held by a lock means 13, or in the anticlockwise direction in the figure to an open position approximately 90° from said closed position and extending upwards, in which opened position said upper cover 11 is maintained by a form of per se conventional lock means, not shown.

On the other side of the printing drum 20, at the upper part of the stencil duplicator, there is provided a stencil master removal and disposal means 110, for removing a used stencil master from the printing drum 20 after all desired stencil printing from said stencil master has been completed. This stencil master removal and disposal means 110 comprises upper and lower drive axles 111 and 112 which extend parallel to one another and parallel to the generators of the printing drum 20 and alongside it, the upper one 111 of these drive axles being selectively rotationally driven in the clockwise direction in the figure by an electric motor 115 which is controlled by the overall control system for the stencil duplicator. On this upper drive axle 111 there are fixedly mounted a plurality of gear wheels 113 (only one of which can be seen in the figure) spaced out in the axial direction, and each of these gear wheels 113 is meshed with a corresponding gear wheel 114 (only one of which can be seen in the figure) which is mounted on the lower drive axle 112, said gear wheels 114 being likewise spaced out in the axial direction on the lower drive axle 112. To the upper and lower drive axles 111 and 112 there are also respectively fixed a plurality of beater tags 116 and 117, which are made of rubber or a rubberlike material and which are elastic. Further, a peel off claw 120 is provided next to the printing drum 20, which is formed as a lever pivoted at its central portion to the frame (not shown) of the stencil duplicator. A tension coil spring 122 biases the peel off claw 120 in the counterclockwise direction in the figure, while a solenoid 121 controlled by the control system for the stencil duplicator is arranged so as selectively to biase said peel off claw 120 in the clockwise direction in the figure. Thus, when the solenoid 121 is not supplied with actuating electrical energy, then the peel off claw 120 is rotated counterclockwise in the figure by the biasing action of the tension coil spring 122, so that the active end 120*a* of said peel off claw 120 is withdrawn from the surface of said printing drum 20; but, when the solenoid 121 is supplied with actuating electrical energy, then the peel off claw 120 is rotated thereby clockwise in the figure against the biasing action of the tension coil spring 122 which is overcome so that said active end 120*a* of said peel off claw 120 is approached very close to the surface of said printing drum 20.

The stencil master removal and disposal means 110 further comprises an upper guide plate 123 and a lower guide plate 124, in between which a used stencil master is fed by being passed between the gear wheels 113 and 114 after being somewhat crushed therebetween; and towards the left in the figure of the gap between said two guide plates 123 and 124 there is provided a lateral feed device 125. This feed device 125 comprises a support shaft 126 on which a plurality of rubber or rubber like rollers 127 are fixedly mounted, and also comprises a serrated metal roller 128, against which said rubber like rollers 127 are frictionally engaged, and which is selectively rotationally driven by an electric motor 132 via a shaft 129 and two gear wheels 130 and 131, said electric motor 132 being controlled by the control system for the stencil duplicator. Thus, when said electric motor 132 is operated, and when said used stencil master is fed against the rollers 127 by the gear wheels 113 and 114, said used stencil master is further entrained between the rollers 127 and the metal roller 128 and is fed in the direction perpendicular to the drawing paper in FIGS. 2 and 3 in the direction away from the viewer, while being further crushed, so as to be finally disposed of in a stencil master disposal box not shown in the figures.

This stencil master removal and disposal means 110 has been developed by various colleagues of the present inventors in the workshops of the company to which the present patent application is assigned; should more details regarding said stencil master removal and disposal means 110 be required, reference should be made to Japanese Patent Application No. Sho 55-17391 (1980) and Japanese Utility Model Application Nos. Sho 54-179596 (1979) and Sho 57-63378 (1982), all of which are assigned to the same assignee as the present application; and the present patent application hereby incorporates the text of those Japanese Patent and Utility Model Applications and the claim or claims and the drawings thereof into this specification by reference.

The control device for the stencil duplicator, which selectively provides actuating electrical energy for all these above described electric motors, solenoids, etc., and which receives electrical signals from the above described sensors and controls, as well as having other functions, comprises a microcomputer and other associated circuitry; but constructional details of this control system for the stencil duplicator, and of the control panel 6 and so on, do not form part of the present invention, and will not be further particularly described herein except in terms of its function, since based upon the disclosures herein various possible structures for this control system, etc., to provide the described function, will be readily conceived of by one of ordinary skill in the control art.

Now the operation of the stencil duplicator for removing an old used stencil master wrapped around the printing drum 20, for charging a new roll of stencil master when so required, and for preparing a new stencil master from a new original and for attaching said new stencil master around the printing drum 20 for printing, will be explained in detail.

First, with regard to the process of removing an old used stencil master, suppose that such a stencil master which has been already used for stencil printing as explained earlier and which is no longer required is still wrapped around the outer surface of the printing drum 20, being clamped thereto along its leading edge by the clamp means 21. For removal, first the printing drum 20 with the used stencil master S therearound is positioned by the operation of the control system for the duplicator to its base rotational position as seen in FIG. 2, and the solenoid 29 is supplied with actuating electrical energy, so as to rotate the lever 26 by the action of said solenoid 29 in the clockwise direction in the figure against the biasing action of the tension spring 30 which is overcome so as to drivingly engage the gear wheel 27 with the gear wheel 25. Next, the gear wheel 27 is appropriately rotated by the electric motor 31 in the clockwise rotational direction so as to rotate the gear wheel 25 and the hinge shaft 23 and the clamp strip 24 in the anticlockwise rotational direction from their previous positions (in which the clamp strip was magnetically held against the permanent magnet strip 22 and was holding the used stencil master) so as now to position the clamp means 21 to the fully unclamped position in which the clamp strip 24 is pivoted approximately 180° away from the permanent magnet strip 22 and thus completely releases the used stencil master. Next, after this has been completed, the control system turns the drive motor 31 for the gear wheel 27 off and deenergizes the solenoid 29 so as to disengage the gear wheel 27 from the gear wheel 25 by turning the lever 26 anticlockwise from the point of view of the figure, and then energizes the solenoid 121 and starts the electric motor 115 and the electric motor 132 operating. This causes the peel off claw 120 to be rotated clockwise in the figure against the biasing action of the tension coil spring 122 which is overcome so that the active end **120*a* of the peel off claw 120 is approached very close to the surface of said printing drum 20. Next, the control system slowly rotates the printing drum 20 through one full revolution in the anticlockwise direction in the figure, so that the end 120*a* of the peel off claw 120 scoops the used stencil master off from the printing drum 20 and directs said used stencil master between the gear wheels 113 and the gear wheels 114 meshed therewith. As this happens, the stencil master is crumpled and mashed by these gear wheels 113 and 114, and is further squashed up by the action of the beater tags 116 and 117 as they thrash it. Then the somewhat mashed up stencil master is ejected to the left of the gear wheels 113 and 114 in the figure between the guide plates 123 and 124, to next become engaged with the lateral feed device 125, in which said used stencil master impacts against the rollers 127 and is entrained between the rollers 127 and the metal roller 128 and is crushed thereby as well as being fed in the direction perpendicular to the drawing paper in FIGS. 2 and 3 in the direction away from the viewer, so as to be finally disposed of in the aforementioned stencil master disposal box, not shown. When this disposal has been completed, the control system stops rotating the printing drum 20 when said printing drum 20 has returned to its base rotational position as seen in FIG. 2, deactivates the electric motors 115 amd 132, and deenergizes the solenoid 121**.

Now, on the other hand, when the stencil duplicator is to be loaded with a new roll of stencil master, the locking device 13 is released and the upper cover 11 is opened by being pivoted around the hinge 12. At this time, the roller 85, the pressure plate 75, the upper roller 93, and the upper blade 98 are all raised up. Thereby, a new roll of stencil master S can easily be loaded in the stencil material storage section 80. Then the leading edge of the stencil master S is pulled by the operator of the duplicator and is unrolled from the roll of stencil material, and then as this leading edge is pulled out the end portion of the roll of stencil material is laid over the roller 82, the light transmitting plate 72, the roller 92, and the lower blade 97 in that order (the lower blade 97 being positioned with the edge thereof downwards at this time), with the leading edge of the stencil master being inserted between the guide plates 100 and 101, on the guide plate 101. For convenience of adjustment, the upper surface of the guide plate 101 may be provided with an index line for showing the proper loading position for the front or leading edge for the stencil master, and in such a case at this time of charging the new roll of stencil master the positioning of the leading edge of the stencil master is made by laying it against this index line. Then the upper cover 11 is closed by being pivoted downwards, and is secured by the locking device 13. Thus the new roll of stencil material S is charged into the duplicator, with the end portion thereof being gripped between the rollers 82 and 85 and also between the rollers 92 and 93.

Now the operation of making a new stencil master according to the pattern on an original and securing said new stencil master around the printing drum 20, ready for printing, will be explained.

First, the original O is placed face down by hand on the original insertion table 2, as shown in FIG. 2, and is pushed in through the original insertion slot 3 for a certain predetermined distance, which may be determined, for example, by aligning the back edge of the original O against the appropriate one of a set of index lines (one corresponding to each possible size for an original) inscribed on the upper surface of the original insertion table 2. At this time, the solenoid 90 is not energized by the control system for the stencil duplicator, so that the roller 85 is raised and a certain gap is present between said roller 85 and the roller 82; and thus the original O passes through this gap between the rollers 85 and 82, sliding on top of the stencil master sheet S which as explained above also is passed through this gap, and the leading edge of the original O is approached to the right hand side of the stencil making means 70, and is inserted between the light transmitting plate 72 of the exposure stage 74 and the pressure plate 75, on top of the stencil master S also therebetween.

The photosensor 107 detects this insertion of the original O, and sends a signal representative thereof to the control system. When the insertion of the original O has been properly accomplished, the control system energizes the solenoid 90, and this, as explained above, causes the roller 85 to be lowered so as to rest against the roller 82 with the original O and the stencil master sheet S clamped therebetween. At this time, the printing drum 20 is positioned by the means for moving it, under control of the control system, to its base rotational position, if it is not there already, and the solenoid 29 is supplied with actuating electrical energy so as to rotate the lever 26 by the action of said solenoid 29 in the clockwise direction in the figure against the biasing action of the tension spring 30 which is overcome so as to drivingly engage the gear wheel 27 with the gear wheel 25. Next, the gear wheel 27 is appropriately rotated by the electric motor 31 in the appropriate rotational direction and by the appropriate amount to rotate the gear wheel 25 and the hinge shaft 23 and the clamp strip 24 so as to position the clamp means 21 to the previously described so called clamp ready position as shown in FIG. 2 in which the clamp strip 24 is removed from the permanent magnet strip 22 but only makes an acute angle therewith. This state of the apparatus is shown in FIG. 2.

Next, the control system drives the electric motor 94, so as to rotate the roller 92 counterclockwise in the figure and the roller 93 clockwise and so as to drive the stencil master material S through between these rollers 92 and 93 leftwards in the figure, and simultaneously with this the control system activates the blower fan 102, so as to blow an air current from diagonally above the left hand edges in the figures of the upper and lower guide plates 100 and 101 towards the printing drum 20. This air current lightly grips the leading edge of the stencil master S as it is advanced by the aforesaid rotation of the rollers 92 and 93, and wafts it in between the permanent magnet strip 22 and the clamp strip 24 of the clamp means 21 which as explained above are in the clamp ready position at this time, forming an acute angle with one another as shown in FIG. 2. This delicate method of handling the leading edge of the stencil master by air blowing is very important for avoiding wrinkling of the stencil master S.

When this leading edge of the stencil master S is properly thus inserted into the gap between the permanent magnet strip 22 and the clamp strip 24, then this fact is detected by the photosensor 103, and the control system then stops operating the electric motor 94, thus ceasing to advance the stencil master S. Further, the control system, while actuating the solenoid 29 so as to drivingly engage the gear wheel 27 with the gear wheel 25, appropriately rotates the gear wheel 27 by the electric motor 31 so as to rotate the gear wheel 25 and the hinge shaft 23 and the clamp strip 24 so as to position the clamp means 21 to the previously described so called clamping position as shown in FIG. 3 in which the clamp strip 24 is resting against and magnetically attracted to the permanent magnet strip 22, with the leading edge of the stencil master S clamped therebetween. When this has been accomplished, then the control system ceases to supply the solenoid 29 with actuating electrical energy, so that the lever 26 is rotated in the anticlockwise direction in the figure by the biasing action of the tension spring 30 so as to disengage the gear wheel 27 from the gear wheel 25.

Now the apparatus is ready for the initial exposure for perforation of the stencil master along an initial strip thereof, the details of which are as follows. First, the electric motor 79 is operated so as to rotate the cam 78, and so as to raise the exposure stage 74 upwards until the light transmitting plate 72 thereof is pressed against the cushion member 76 on the pressure plate 75, with the sandwich of the stencil master S under the original O squeezed between them. When this has been fully accomplished, the control device activates the light source 73 within the exposure stage 74, so as to illuminate the part of the downward facing side of the original O which is visible at this time through the light transmitting plate 72 through the stencil master S squeezed thereagainst. This part of the original O has the form of a transverse strip thereon; generally, it does not include the whole of the pattern on the original for which copies are required to be made, but is only an initial or leading strip thereof. Because the radiation thus emitted from the light source 73 engenders considerable heat in the dark portions of the original O which are exposed thereto, this heat causes the portions of the stencil master sheet S pressed thereagainst to effectively disappear; these portions are melted and curl up, being reduced to vestigial or nonexistent remnants by the action of this heat. In other words, a portion of the stencil master sheet S is perforated by the per se well known thermal perforation process in a pattern corresponding to that on the aforesaid corresponding exposed strip of the original O. Once this perforation is completed, the electric motor 79 is again energized so as to rotate the cam 78 this time in the reverse direction to that previously employed, and thereby the exposure stage 74 is lowered, thus releasing the squeezing of the light transmitting plate 72 against the cushion member 76 on the pressure plate 75, and releasing the squeezing of the sandwich of the stencil master S under the original O between them. However, at this time, the stencil master S remains as adhered to the original O, as an aftermath of the stencil perforation process; this is a per se well known property of the thermal perforation method.

Next, the electric motor 33 is actuated by the control system, so as to rotate the printing drum 20 slowly in the anticlockwise direction in the figure through a controlled angle. This state of the device is shown in FIG. 3. This operation pulls gently on the stencil master S, the leading edge of which is as explained above secured along the clamp stage **22*a* by the clamp strip 24 of the clamp means 21, and thereby the stencil master S is moved leftwards in the figures and is progressively wound around the printing drum 20, more of said stencil master S being unrolled from the roll thereof in the stencil master storage section 80, and the original O is likewise moved leftwards in the figures, being as explained above adhered to the stencil master S over the portion thereof which has been exposed and perforated. At this time, the electric motor 94 is not supplied with actuating electrical energy, and accordingly the roller 92 is not positively rotationally driven thereby; but according to the action of the aforementioned one way clutch the rollers 92 and 93 are allowed to rotate in a passive way, following the motion of the stencil master S, while providing a certain predetermined amount of gentle resistance; this provides an appropriate tension for the stencil master S as it is wound onto the printing drum 20, and ensures that no wrinkles are allowed to form therein. During this motion of the stencil master S and the original O, as the adhered together sandwich thereof moves out from the left hand side of the stencil making means 70, the stencil master S which is very flexible is as explained previously bent downwards through a sharp angle, almost a right angle, by the separation claw 95, as it approaches towards the rollers 92 and 93, while on the other hand the original O, which is inherently quite stiff, is not so bent; and accordingly the perforated portion of the stencil master S is peeled away from the original O, and the original O is forwarded along between the guide plates 105 and 106 towards the original ejection slot 5, while the perforated portion of the stencil master S is moved towards the printing drum 20** to be wound thereon.

This rotation of the printing drum 20 and winding of the stencil master S thereon is continued for a predetermined angle, as mentioned above, until the exposed portions of the original O and the stencil master sheet S have just been moved away from the light transmitting plate 72, with a new strip of the original O and a corresponding new strip of the stencil master S now located between the light transmitting plate 72 and the pressure plate 75; in fact, a small overlap strip between said old and new strips of the original O and the stencil master S is allowed to be present, and does not significantly deteriorate the quality of the stencil perforation process. At this point, the rotation of the printing drum 20 is stopped by the control system, and the above described step of raising the exposure stage 74 of the stencil perforation means 70 is again performed, to again squeeze the sandwich of the next strip of the original O and the next strip of the stencil master S. Then again the light source 72 is operated to expose and perforate this next stencil master strip; and again the exposure stage 74 is lowered and the printing drum 20 is rotated through said certain predetermined angle. These steps of exposure and then pulling of the stencil master by rotation of the printing drum 20 are alternatingly repeated a number of times, and in this way successive strips of the stencil master S are exposed and perforated in a pattern corresponding to that on the original O, and the thus stepwise exposed and perforated stencil master S is progressively wound onto the printing drum 20, while the original O is correspondingly progressively fed towards and out of the original ejection slot 5.

This repeated exposure and winding process is carried on until the photosensor 107 detects that the trailing edge of the original O has passed it, and after this the supply of electrical energy to the solenoid 90 is terminated, thus causing the roller 85 to rise up away from the roller 82, and one last perforating exposure of the last portion of the original O is made. Then the exposure stage 74 is lowered for good, and the actuation of the electric motor 79 is finally terminated; and next the printing drum 20 is continuously rotated counterclockwise by the motor 33, while the original O becomes completely separated from the stencil master S which is being would onto said printing drum 20; the original O may in fact be completely ejected from the machine through the original ejection slot 5 by rollers or the like not shown in the figures. When the rotation of the printing drum 20 has proceeded through a predetermined angle from the initial or base rotational position, said angle being appropriately nearly a full revolution such as an angle of 330° for example, then the electric motor 99 is started by the control system and the lower or rotary blade 97 of the cutter means 96 is rotated through one full revolution so as to cut the stencil master S cleanly across with one transverse cut as explained above; during this cutting process, by the operation of the aforementioned one way clutch and the drive belt 118, the rollers 92 and 93 are positively rotated, so as to relieve the tension in the stencil master S produced by the pulling of the printing drum 20 and so as to allow for a clean cut. After the actual cutting process, the returning of the rotary blade 97 round to its lower position rotates the rollers 92 and 93 through a sufficient angle to advance the newly cut leading edge of the stencil master S towards and between the guide plates 100 and 101, ready for a future operation of preparing a new stencil master. Meanwhile and subsequently, the slow and steady rotation of the printing drum 20 is continued, thus finishing the wrapping of the perforated and cut stencil master S around the periphery of said printing drum 20. In fact, during this initial wrapping rotation of the printing drum 20, it is possible simultaneously to print the first copy from the new stencil master S wound therearound, even before the wrapping has been completely finished, in the fashion explained hereinabove; this first printed copy may advantageously be a proof copy.

This completes the explanation of preparing a new stencil master from a new original and of attaching said new stencil master around the printing drum for printing. The control system for the stencil duplicator may advantageously be arranged to operate in such a way that, if the start button 7 is pressed when the photosensor 107 is detecting that no new original O is inserted into the original insertion slot 3, then stencil printing is resumed using the old stencil master S which remains wrapped around the printing drum 20 from a previous stencil printing operation. In other words, the operation of removing an old stencil master S from the periphery of the printing drum 20 is advantageously arranged only to be performed when a new stencil master S is definitely required to be prepared, according to the insertion of a new original O in the original insertion slot 3.

Thus, it is seen that that the present invention provides an entirely automatic stencil duplicator which does not require any manual intervention for making stencil masters, for printing copies therefrom, and for disposing of the used stencil masters, and which can provide a high degree of pressure between an original and a piece of thermal stencil master material which is to be perforated according to the pattern on said original, in order to provide a high quality of stencil perforation with high resolution. Further, the problems described earlier with respect to the prior art of wrinkling in the stencil master material during the manufacture of a perforated stencil master, as well as during the process of wrapping the perforated stencil master onto the printing drum for subsequent printing therefrom, are avoided. Thus, this duplicator is able to be applied to the use of continuous roll thermal master sheet material, and does not require the provision of any reinforced header portions on the stencil masters for handling and fixing them. Further, during operation of this stencil duplicator, wrinkles in the stencil master material caused during the stencil perforation process are not caused to be accentuated during the process of wrapping the perforated stencil master onto the printing drum for subsequent printing therefrom due to tension provided in said perforated stencil material for the purpose of avoiding the generation of transverse wrinkles therein, but rather are smoothed out.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown embodiment, or of the drawings, but solely by the scope of the appended claims, which follow.

What is claimed is:

1. Stencil duplicator comprising:

a rotary cylindrical printing drum having a cylindrical wall having an outer and an inner cylindrical surface and formed with multiple holes therethrough, said printing drum being mounted to be rotatable around a central axis thereof and further having a clamping means arranged along a generatrix of the cylindrical shape thereof for fastening a leading edge of a stencil strip to the outer cylindrical surface thereof along said generatrix;

a means for supporting a roll of the stencil strip to be rotatable around a central axis thereof arranged in parallel to said central axis of said printing drum so as to supply the stencil strip toward said printing drum;

a first driving means for selectively driving said printing drum in a rotational direction so as to take up the stencil stip from said roll and to lay said stencil strip around said printing drum starting from a leading edge thereof when the leading edge is fastened to said printing drum by said clamping means and so to perform printing with the stencil strip laid therearound;

a means for perforating said stencil strip, positioned between said printing drum and said roll supporting means, comprising a light transmitting plate, a flash light source which selectively irradiates light beams through said light transmitting plate, a pressure plate facing said light transmitting plate, a second driving means for selectively driving at least one of said light transmitting plate and said pressure plate toward and away from the other so that said light transmitting plate and said pressure plate may either be selectively pressed together or separated from one another, and a means for feeding an original sheet to be laid over the stencil strip, said stencil perforating means perforating said stencil strip according to black portions in an image of said original sheet over a predetermined rectangular area in each cycle of operation of pressing said light transmitting plate and said pressure plate together and flashing said flash light source, said rectangular area having a predetermined first dimension along a direction of feeding of said stencil strip;

a means for initially feeding the stencil strip from said roll toward said printing drum through a space between said light transmitting plate and said pressure plate so that the leading edge of the stencil strip is fed to said clamping means of said printing drum only when said printing drum is held at a stencil clamping base rotational position thereof;

a means for cutting said stencil strip to a predetermined length at the end of feeding thereof;

a means for supplying printing ink to the inner cylindrical surface of said printing drum;

a means for feeding printing sheets successively toward said printing drum and pressing each printing sheet toward the outer cylindrical surface of said printing drum so as to be printed by the ink conducted through said multiple holes from the inside to the outside of said printing drum and through perforated portions of said stencil strip wrapped around said printing drum; and a control means for controlling said clamping means, said stencil strip feeding means, said first and second driving means, said flash light source and said stencil strip cutting means in a co-related manner such that, in a first stage of operation, said stencil strip feeding means is operated to feed the leading edge of the stencil strip toward said clamping means of said printing drum; in a second stage of operation in a first mode of operation, said first driving means is operated so as to drive said printing drum in said rotational direction so as to continue feeding and take up of the stencil strip for a predetermined length thereof which is smaller than said first dimension through the space between said light transmitting plate and said pressure plate while said second driving means is operated so as to separate said light transmitting plate and said pressure plate from one another, and in a second mode of operation said first driving means is operated so as to stop rotation of said printing drum and therefore the taking up of the stencil strip while said second driving means is operated so as to press said light transmitting plate and said pressure plate together and then switching on said light source, said first and second mode operations being repeated one after the other for predetermined times, respectively; in a third stage of operation, said stencil strip cutting means is operated so as to cut the stencil strip transversely at a position between said stencil strip perforating means and said printing drum and in a fourth stage of operation, subsequent to said third stage, said first driving means further drives said printing drum in a continuous rotating manner to perform printing by said printing drum while loaded with the perforated stencil sheet.

2. A stencil duplicator according to claim 1, wherein said stencil strip feeding means idles when the stencil strip is fed as being taken up by said printing drum being intermittently driven by said first driving means, while applying a small resistance to the stencil strip.

* * * * *